United States Patent [19]

Ieraci

[11] Patent Number: 4,894,865

[45] Date of Patent: Jan. 23, 1990

[54] FOAM SCARF

[76] Inventor: Bruno Ieraci, 248 Rockaway Pkwy., Valley Stream, N.Y. 11580

[21] Appl. No.: 343,427

[22] Filed: Apr. 26, 1989

[51] Int. Cl.[4] ..... A41D 23/00

[52] U.S. Cl. ..... 2/91; 2/207

[58] Field of Search ..... 2/171, 185 R, 200, 199, 2/202, 206, 207, 91, DIG. 11

[56] References Cited

U.S. PATENT DOCUMENTS

| | | | |
|---|---|---|---|
| 1,936,045 | 11/1933 | Bachrach | 2/91 |
| 2,042,442 | 5/1936 | Buchman | 2/91 |
| 2,510,720 | 6/1950 | Siegel | 2/91 |
| 3,172,135 | 3/1965 | Coolidge | 2/91 X |
| 4,335,471 | 6/1982 | Quigley, Jr. et al. | 2/200 X |
| 4,646,367 | 3/1987 | El Hassen | 2/DIG. 11 X |
| 4,654,897 | 4/1987 | Rosaen | 2/207 |
| 4,665,566 | 5/1987 | Garron | 2/DIG. 11 X |
| 4,698,852 | 10/1987 | Romero | 2/DIG. 11 |
| 4,747,164 | 5/1988 | Foulke | 2/200 X |
| 4,771,477 | 9/1988 | Cahill | 2/200 X |

*Primary Examiner*—Werner H. Schroeder
*Assistant Examiner*—Jeanette E. Chapman
*Attorney, Agent, or Firm*—Bauer & Schaffer

[57] ABSTRACT

There is disclosed a scarf having an elongated, lightweight body of a foam material such as polyurethane foam, and which body has a plurality of spaced, transverse slits located at one end and opposing notches located at the opposite end forming a hook-like shape at the opposite end and being adjustable for use by wearers having different neck sizes when the hook-like shape is inserted through the slits.

9 Claims, 1 Drawing Sheet

Fig. 1
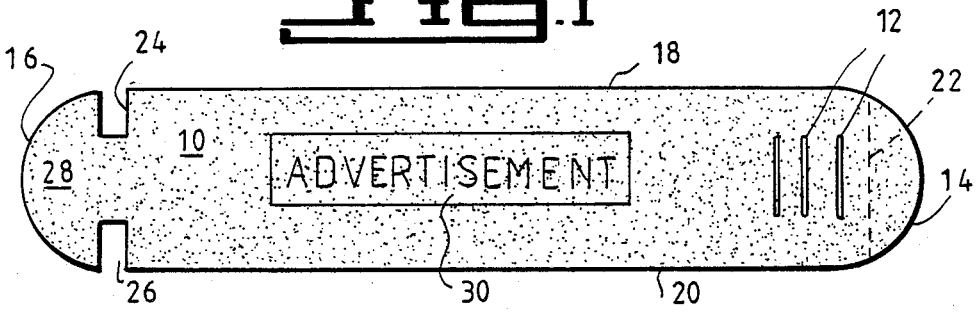
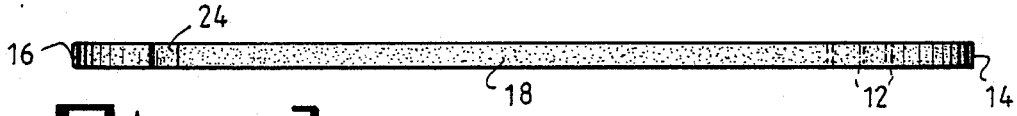
Fig. 2
Fig. 3
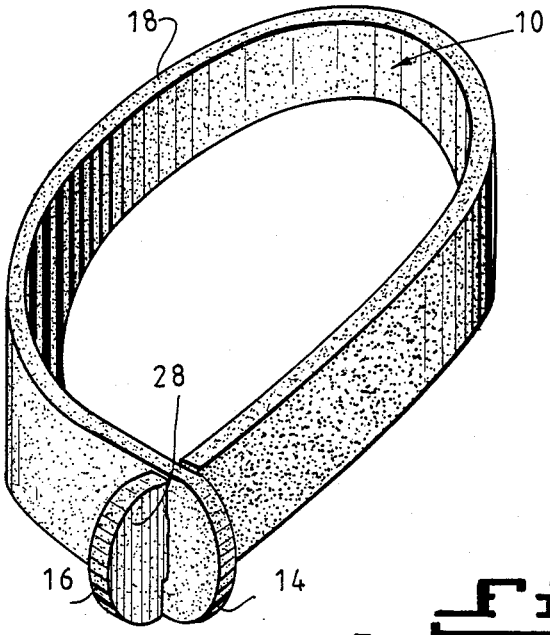
Fig. 4
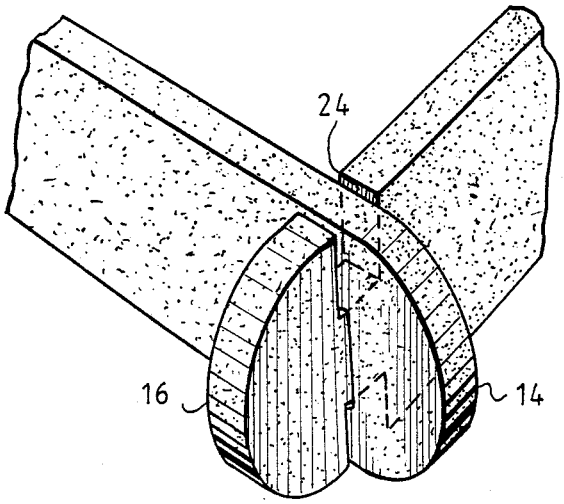

FOAM SCARF

This invention relates to an article of wearing apparel. More particularly, the invention relates to a scarf.

BACKGROUND OF THE INVENTION

Scarves or mufflers are known which are useful for both decorative and utilitarian purposes. Generally, a scarf is made from an elongated piece of fabric which is of a length substantially longer than the circumference of a wearer's neck and a width longer than the vertical extent of the neck so that in use it may be wrapped at least once around the neck and knotted in place. As a result, the neck is protected from exposure to inclement weather.

Decorative scarves have the same general construction as utilitarian scarves, but they are generally made from thinner or lighter material. Consequently, such decorative scarves, while they adequately fulfill a wide variety of esthetic needs, do not provide much protection against the elements. Moreover, most known scarves, whether they are made to provide decorative and/or utilitarian needs, usually have an elongated body substantially longer than a wearer's neck circumference. Thus, they have dangling ends which can pose a danger to the health and safety of a wearer, especially if the wearer is near or operating equipment or machinery. Furthermore, the width of a conventional scarf often results in uneven longitudinal stretching of the material when the scarf is wrapped and tied about the neck since the neck possesses a diversely curved surface. Thus, there exists a need for a scarf which does not exhibit such disadvantages.

While U.S. Pat. No. 4,654,897 to Rosaen discloses a scarf which in some respect overcomes the above-mentioned disadvantages, the scarf disclosed there in and or itself exhibits certain drawbacks. For example, it is made of fabric and provided with Velcro fastening means which may be relatively separated when in use and also has a body made of fabric which may have limited qualities in provided protection against the elements.

There exists, therefore, the need for a scarf of still better properties with respect to protection against the elements as well as fastening means which are even less likely to become undone in use. The present invention provides a scarf which fulfills such a need.

SUMMARY OF THE INVENTION

In accordance with the invention there is provided a scarf comprising an elongated, lightweight body of foam material having a pair of faces, a pair of ends, and a length slightly greater than the circumference of the wearer's neck and which is bounded by spaced, parallel, peripheral edges. A plurality of spaced, transverse slits are located towards one end of the body, while the opposite end is provided with notches forming a hook-like shape in the body capable of being held in the slits. Consequently, an adjustable length scarf for use by wearers having different neck sizes is provided, and is one which does not require an inordinate length to provide a knot.

THE DRAWINGS

In order to describe the scarf of this invention more fully, reference is directed to the accompanying drawings which are to be taken in conjunction with the following description and in which drawings:

FIG. 1 is a perspective view of a scarf according to the invention, showing the foam body, transverse slits, and notches forming the hook-like shape;

FIG. 2 is a plan view of the foam body shown in FIG. 1; and

FIG. 3 is an elevational view of an individual with the scarf disposed about his or her neck.

DESCRIPTION OF THE PREFERRED EMBODIMENTS

Referring now to FIG. 1, a scarf in accordance with this invention has a body 10 which is made of an elongated, lightweight foam material. A wide variety of foam materials may be used in forming the body of the scarf of this invention. Such materials include, but are not limited to, polyurethane foam material, polyethylene foam material, nylon foam material, and polyester foam material, and the like. Polyurethane foam is a preferred foam material; however, no matter which particular foam is employed to form the body 10, it should have a low density so as to be light in weight and highly flexible it should have a cell structure which is not too porous to prevent rapid passage of air and thereby provide good insulation properties. In this respect the density of the foam taken together with the thickness of the body is such that the body can be facilely draped about the neck of a user while still providing the degree of protection against the elements. A suitable thickness for the scarf is about 0.5 inches.

The length of the body 10 may vary; however, from a practical viewpoint, it is generally about 34 inches, while the width thereof is generally about 4.0 inches so that it conforms generally to the vertical extent of the neck.

As may be seen from FIG. 1 the scarf body is provided towards one end with a plurality of spaced, transverse slits 12 which are provided in the body when the body is shaped. The body 10 is also provided with a pair of curved ends 14 and 16 and is bounded by spaced, parallel peripheral edges 18 and 20 along the length thereof. On the other hand, the end of the body towards which the slits 12 are located can be straight as shown by broken line 22 in FIG. 1.

At the opposite end 16 of the body 10, the body is provided with opposing notches 24 and 26, forming a shaped hook-like tip 28 integral with the main body portion 10. Accordingly, the scarf is adjustable for use by wearers having different neck sizes when the hook-like tip 28 is inserted through a selected one of the slits 12. Attachment of the scarf about the neck is easily made by the "pinch and poke" method even though the user does not have direct visual access to the neck.

The scarf of the present invention lends itself easily to its use as a highly decorative scarf, novelty clothing, advertising media, or the like by providing on one or both faces, as shown at 30, advertising, logo, artwork, or similar decorative messages may be located on the foam body on one or both faces thereof if desired.

As shown in FIG. 3 a scarf according to the invention can be draped around the neck of the user with the body 10 securely and comfortably worn and held in place by inserting hook-like shape 28 through an appropriate slit 12. In general, the scarf will closely hug the wearer's neck much in the manner of a collar or choker.

It is to be understood that it is within the purview of this invention to locate the slits 12 closer or further away from the end 14 of the body 10 and as well increase or decrease the number of slits if desirable. The indicia applied to the scarf may be formed during the foaming of the material or may be printed thereon afterward. School names, team names, pennants, and the like, as well as holiday messages, may be provided.

As it will be seen, the scarf may be made in a very small number of size differences to accommodate both adults and children's sizes. The body of the scarf may also be created in a variety of shapes and sizes, for example, one readily apparent would be that of the outline of a fish. Other animal shapes or free-form shapes will be readily apparent to those skilled in the art. The scarf may also be produced with the notches being only indicated by scoring or other markings and the material of the notches themselves removed by the user simply by cutting them to provide the hook. These notches themselves may take a variety of shapes and forms, all retaining the "pinch and poke" closeability.

The scarf may be used for warmth in cold weather as will, of course, be obvious. What is not so obvious may be the fact that it may also be used in warm weather as a cooling media simply by moistening the foam and allowing the moisture to evaporate while the scarf is being worn. Because of the foam nature of the scarf, it also becomes an excellent companion to take to the gym as a workout sweat sponge or sponge by which to spread suntan lotion, etc.

The scarf of this invention presents numerous advantages. It is of simple construction and is made of readily available materials. It may be made by simple procedures on available machines or processing equipment or by hand. In addition, it can be used by several people, each person having a different neck size, and provides fastening means which cannot be easily dislodged when the scarf is in use. Numerous other advantages will be apparent to those skilled in the art.

What is claimed is:

1. A scarf comprising an elongated, lightweight body of foam material having a pair of faces, a pair of ends, and a length at least somewhat greater than the circumference of a wearer's neck and which is bounded by spaced, parallel, peripheral edges, a plurality of spaced transverse slits located towards one end of said body, and opposing notches located in said body towards the opposite end and forming a hook-like shape in said body and making said scarf adjustable for use by wearers having different neck sizes when said hook-like shape is inserted through said slits.

2. The scarf according to claim 1 wherein the body is polyurethane foam.

3. The scarf according to claim 1 wherein the body is polyethylene foam.

4. The scarf according to claim 1 wherein the body is nylon foam.

5. The scarf according to claim 1 wherein the body is polyester foam.

6. The scarf according to claim 1 wherein the spaced, transverse slits are pointed slits.

7. The scarf according to claim 1 wherein both of the ends of the body are rounded.

8. The scarf according to claim 1 wherein the end of the body nearest the spaced, transverse slits is straight

9. The scarf according to claim 1 wherein advertising or logo artwork is located between the ends of the body on one or both faces.

* * * * *